US009788585B2

(12) United States Patent
Thompson et al.

(10) Patent No.: US 9,788,585 B2
(45) Date of Patent: Oct. 17, 2017

(54) SEAMLESS RIDGE REINFORCED GLOVE

(71) Applicant: Ansell Limited, Richmond, Victoria (AU)

(72) Inventors: Eric M. Thompson, Central, SC (US); Norberto Hector Perales Solis, Chihuahua (MX); Chancelor Wyatt, Somerset, NJ (US); Sean Sweeney, Jackson, NJ (US); Agustin Portillo Mercado, Chihuahua (MX)

(73) Assignee: Ansell Limited, Victoria (AU)

( * ) Notice: Subject to any disclaimer, the term of this patent is extended or adjusted under 35 U.S.C. 154(b) by 890 days.

(21) Appl. No.: 13/766,407

(22) Filed: Feb. 13, 2013

(65) Prior Publication Data

US 2013/0205469 A1 Aug. 15, 2013

Related U.S. Application Data

(60) Provisional application No. 61/598,134, filed on Feb. 13, 2012.

(51) Int. Cl.

| | |
|---|---|
| ***A41D 19/015*** | (2006.01) |
| ***A41D 19/00*** | (2006.01) |
| ***D04B 1/28*** | (2006.01) |

(52) U.S. Cl.

CPC ..... *A41D 19/015* (2013.01); *A41D 19/0065* (2013.01); *A41D 19/01558* (2013.01); *D04B 1/28* (2013.01); *A41D 19/01505* (2013.01); *A41D 2400/80* (2013.01); *A41D 2500/10* (2013.01)

(58) Field of Classification Search

CPC . D04B 7/34; D04B 1/28; A41D 19/00; A41D 19/15; A41D 31/0055

USPC ..... 66/174

See application file for complete search history.

(56) References Cited

U.S. PATENT DOCUMENTS

| | | | | | |
|---|---|---|---|---|---|
| 2,050,998 | A * | 8/1936 | Ganson | D04B 1/24 | 66/174 |
| 2,452,707 | A * | 11/1948 | Wirtz | D04B 1/102 | 66/169 R |
| 2,942,442 | A * | 6/1960 | Egbert | A41D 19/01511 | 15/227 |
| 3,788,103 | A * | 1/1974 | Asai | D04B 7/34 | 66/174 |
| 4,000,903 | A * | 1/1977 | Swanson | A63B 71/146 | 2/161.3 |
| 4,470,251 | A * | 9/1984 | Bettcher | A41D 19/01511 | 2/16 |
| 5,070,540 | A | 12/1991 | Bettcher et al. | | |

(Continued)

FOREIGN PATENT DOCUMENTS

| | | |
|---|---|---|
| CN | 101715307 A | 5/2010 |
| CN | 101977523 A | 2/2011 |

(Continued)

OTHER PUBLICATIONS

International Search Report and Written Opinion dated Jun. 2, 2013 for International Application No. PCT/US2013/025922.

(Continued)

*Primary Examiner* — Richale Quinn
(74) *Attorney, Agent, or Firm* — Moser Taboada

(57) ABSTRACT

A seamless knitted glove that includes a knitted ridge is disclosed. Methods for forming the glove are disclosed.

14 Claims, 5 Drawing Sheets

(56) References Cited

U.S. PATENT DOCUMENTS 5,239,846 A * 8/1993 Kitaura ..... D04B 1/28 66/172 R
5,442,815 A * 8/1995 Cordova ..... A41D 19/0055 2/161.7
5,471,682 A 12/1995 Robins et al.
6,155,084 A * 12/2000 Andrews ..... A41D 13/08 2/16
6,161,400 A * 12/2000 Hummel ..... A41D 19/01505 2/16
6,945,080 B2 * 9/2005 Maeda ..... A41D 19/00 2/169
6,962,064 B1 * 11/2005 Hardee ..... A41D 19/00 2/159
7,434,422 B2 * 10/2008 Thompson ..... A41D 19/00 2/159
7,669,442 B1 * 3/2010 Zhu ..... A41D 19/01511 66/174
7,908,891 B2 * 3/2011 Thompson ..... A41D 19/0065 66/174
8,621,890 B2 * 1/2014 Veillet ..... A41D 19/01505 66/174
2009/0055992 A1 * 3/2009 Thompson ..... A41D 19/0065 2/164
2009/0183296 A1 * 7/2009 Hardee ..... D02G 3/185 2/161.8
2009/0211305 A1 * 8/2009 Thompson ..... A41D 19/0065 66/174
2010/0011484 A1 * 1/2010 Williams ..... D04B 1/28 2/161.8
2010/0186457 A1 * 7/2010 Zhu ..... A41D 19/01505 66/174
2010/0275341 A1 * 11/2010 Sweeney ..... A41D 19/01505 2/164
2011/0209505 A1 * 9/2011 Thompson ..... A41D 19/01547 66/174
2012/0204604 A1 * 8/2012 Azeem ..... D04B 1/28 66/174
2013/0000360 A1 * 1/2013 Ashworth ..... D04B 1/28 66/174
2013/0213094 A1 * 8/2013 Moreland ..... D04B 1/28 66/174
2014/0290312 A1 * 10/2014 Atwood ..... A41D 19/015 66/174

FOREIGN PATENT DOCUMENTS

CN 102458168 A 5/2012
GB 726922 A 3/1955
JP 11-269706 10/1999
JP 11269706 A 10/1999
JP 2002285412 A 10/2002
JP 2002285412 A 10/2002
JP 2010281000 A 12/2010
JP 2010281000 A 12/2010

OTHER PUBLICATIONS

Supplementary European Search Report dated Oct. 12, 2015 for Application No. 13749364.9—1705.
Chinese Office Action dated Sep. 13, 2016 for Application No. 201380009239.9.

* cited by examiner

SEAMLESS RIDGE REINFORCED GLOVE

CROSS-REFERENCE TO RELATED APPLICATIONS

This application claims the benefit of priority under 35 U.S.C. 119(e) to U.S. Provisional Application Ser. No. 61/598,134 filed Feb. 13, 2012, which is hereby incorporated by reference in its entirety.

BACKGROUND

Field of the Invention

Embodiments of the present invention generally relate to gloves and, more particularly, to a seamless glove comprising reinforced ridges for external force, impact, and vibration dissipation and abrasion- and cut-resistance. Methods of making the glove are disclosed.

Description of the Related Art

Gloves are used in many industries and households to protect the hands of users. Many gloves are designed with specific applications in mind. For example, gloves may be specified for comfort, flexibility, dexterity as well as for high impact, shock absorption, durability, abrasion, and cut-resistance. However, many of such gloves are difficult to manufacture and require additional materials and manufacturing processes. Also, gloves cannot typically offer a balance of the foregoing properties. Therefore, there is a need in the art for a seamless, impact-dampening, and/or cut-resistant glove having excellent grip properties that is flexible, comfortable, and easy to manufacture.

SUMMARY OF THE INVENTION

Seamless knitted gloves that includes at least one knitted ridge, substantially as shown in and/or described in connection with at least one of the figures, as set forth more completely in the claims, are disclosed. Methods for forming gloves are also disclosed. Various advantages, aspects, and novel features of the present disclosure, as well as details of an exemplary embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the drawings illustrate only some embodiments of this invention and are not to be considered limiting of its scope, for the invention admits to other equally effective embodiments. It is to be understood that elements and features of one embodiment may be in other embodiments without further recitation and that identical reference numerals have been used to indicate comparable elements common to the figures.

DETAILED DESCRIPTION

Embodiments of the present invention comprise a seamless, knitted glove having knitted ridges, which can be knitted with one or more yarns, eliminating the need for sewing or otherwise adhering different materials for impact and abrasion protection. A liner may be knitted by conventional knitting process and comprise various yarns, deniers, and gauges. A knitted glove comprises a main yarn and optionally a second ridge yarn knitted therewith. The ridge yarn may comprise polyester, nylon, SPANDEX®, LYCRA™, NOMEX®, TWARON®, KEVLAR®, DYNEEMA®, SPECTRA®, steel wire, natural rubber, fiberglass, carbon, shear thickening fluids, and the like or any blend of the fibers and materials. Gloves in accordance with embodiments of the invention may be knitted using automatic seamless glove knitting machines, such as, but not limited to, NSFG, SFG-1, and SWG by Shima Seiki Mfg., Ltd.

Figure 1:
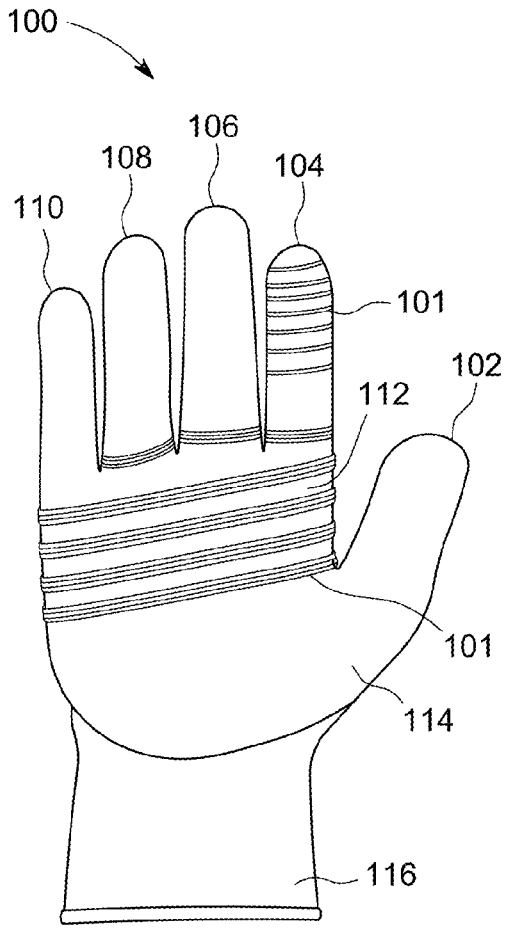
FIG. 1 depicts the palm side of a liner according to embodiments of the invention.

FIG. 1 depicts the palm side of a liner according to embodiments of the invention. Liner 100 comprises thumb 102, index finger 104, middle finger 106, ring finger 108, and pinky finger 110, upper palm 112, lower palm 114, and cuff 116. Liner 100 may comprise several ridges 101 on lower palm 114, upper palm 112, or fingers 104, 106, 108, 110, and thumb 102. Liner 100 may comprise several different designs for glove size, the amount and placement of ridges, and/or ridge dimensions. Ridges 101 are chosen for selective reinforcement in various areas of liner 100 and may be defined by their height H as projecting from the surface of liner 100, width W, and spacing S between ridges.

In FIG. 1, for example and not by limitation, upper palm 112 has four sets of ridges 101 and index finger 104 has seven sets of ridges 101. In some embodiments, the height of ridges 101 on the fingers may range from essentially flush (such as 0.1 mm) with the surface of the main yarn of the liner 100 to 1 mm in height. Spacing S may be approximately as little as 0.2 mm to 2 mm and Width W may be approximately 3 mm. Upper palm 112 of glove 100 may comprise ridges 3 mm in width W, 2 mm in spacing S, and height H between 0-1 mm. Ridges 101 are typically disposed perpendicular to the longitudinal axis of the liner for increasing the grip properties of the glove, particularly on the palm side of the liner. Alternatively, ridges 101 may be disposed differently, such as parallel to the longitudinal axis, for other applications. In some embodiments of the present invention, some regions of the glove have ridges disposed both parallel and perpendicular to the longitudinal axis of the glove.

Figure 2:
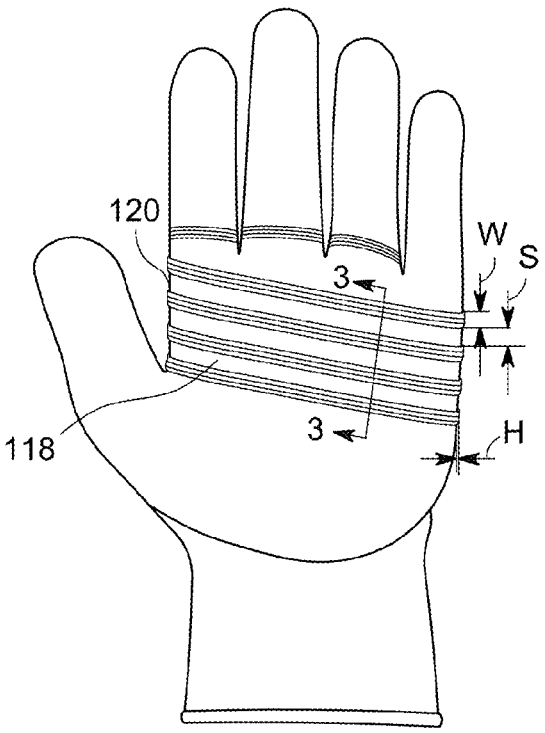
FIG. 2 depicts the back side of the liner of FIG. 1, according to embodiments of the invention.
Figure 3:
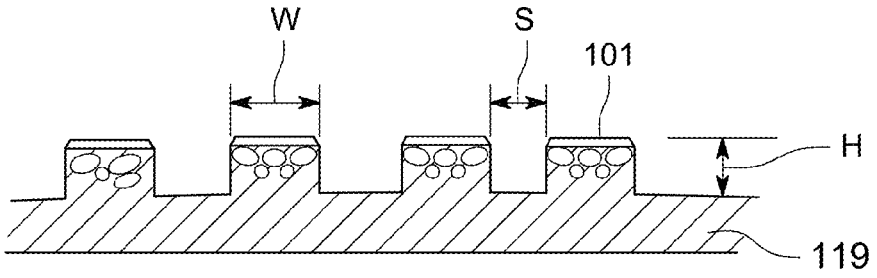
FIG. 3 depicts a cross-section taken along line 3-3 of the liner in FIG. 2.

Gloves in accordance with embodiments of the invention may further comprise indicia of the properties of the glove, based on the amount, and/or dimensions, of the ridges. For example, gloves may be indicated for certain duties, which can be characterized as light, medium, or heavy duty. A glove of the foregoing design will have maximum flexibility and very good grip, abrasion, durability, and impact resistance properties and could be considered for light duty for many applications. Nonetheless, in some embodiments, the design can be varied for more demanding applications. For example, the heights of ridges 101 in upper palm area may be between 2-8 mm. Also, as shown in FIG. 2, knuckle area 120 and backhand area 118 may optionally comprise ridges 101. FIG. 3 depicts a cross-section taken along line 3-3 of the liner shown in FIG. 2, further displaying the width W, spacing S, and height H of ridges 101 disposed on top of main yarn 119. As discussed below, ridges 101 need not traverse a lateral circumference of liner 100 and instead include discontinuous ridges as is discussed below. Liner 100 may optionally comprise a cuff 116 having a size-adjustment, for example, by hook-and-loop fasteners, such as a VELCRO® attachment.

Ridges 101 comprise a yarn having a different size and/or stretchability than the main yarn. For example, and not limitation, for a light duty glove, ridges 101 comprise a textured nylon yarn. Embodiments of the invention also comprise where the main yarn and ridge yarn are different colors. For medium and heavy duty gloves, ridges 101 may comprise a SPANDEX® or LYCRA™ yarn core, which is wrapped with a nylon yarn, though design choices and selection are not limited thereto.

Ridges 101 may be formed in several ways. One manner in which ridges may be formed is by the needle of the machine knitting over one part of the ridge several times, building up a higher ridge with each pass. This can be accomplished by a model SWG machine. Another way in which ridges 101 can be formed is by changing the main yarn to the ridge yarn while varying stitch dimensions, for example, yarn tension. The tension of the yarn may be varied by adjusting the tension of the yarn between a pinch roller and a knitting head by computer control of a knitting machine, as is disclosed in commonly-assigned U.S. patent application Ser. No. 11/444,806, which is herein incorporated by reference in its entirety. Stitch dimensions can also be controlled by varying the depth of penetration of the knitting needle into the knitted liner formed by the main yarn and by casting off or picking up additional stitches in a course. Ridges 101 may also be formed by variable plaiting the ridge yarn on top of the main yarn while varying tension of the ridge yarn. Ridges of this design may be formed with the SFG-I and NSFG model machines. Substituting or plaiting one course at a certain tension forms a certain ridge height. Knitting two or more courses, such as three, four, five, etc., courses, provides a wider ridge as well as a greater height. Ridges formed in accordance with this embodiment of the invention allow both continuous ridges as well as discontinuous ridges, as is discussed below. Liners knitted in accordance with embodiments of the invention may optionally comprise polymeric material coatings as is discussed below.

Figure 4:
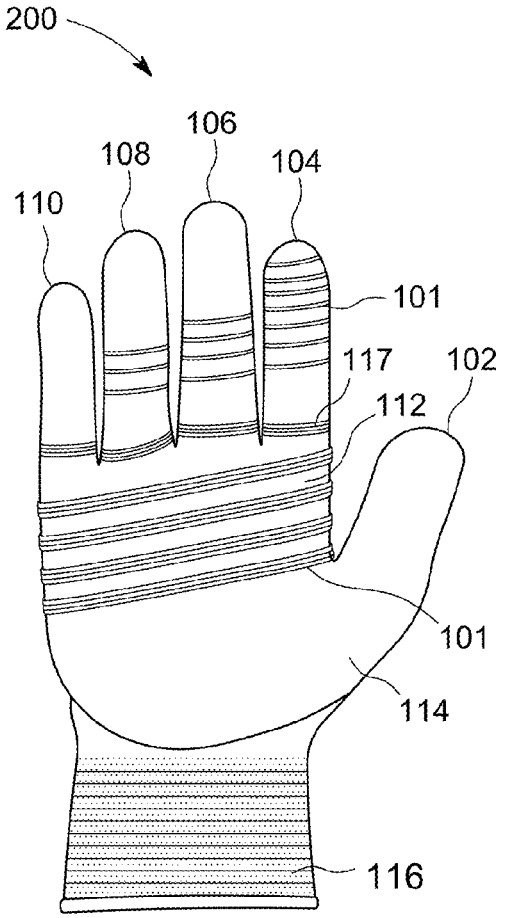
FIG. 4 depicts the palm side of a liner according to embodiments of the invention.

FIG. 4 depicts the palm side of a liner according to embodiments of the invention. Liner 200 is shown in FIG. 4. Liner 200 may comprise ridges 101 on cuff 116, upper palm 112, back hand area 118, and on fingers 104, 106, 108, and 110. As shown, index finger 104 comprises seven sets of ridges 101, middle finger 106 comprises four sets of ridges 101, ring finger 108 comprises three sets of ridges 101, and pinky finger comprises one set of ridges 101. The crotches made between the palm 112 and index finger 104, middle finger 106, and ring finger 108 may optionally comprise a ridge 117. Ridge 117 may be only on palm side 112 and/or, alternately, on the back hand. Upper palm 112 includes four sets of ridges 101. In some embodiments, the height H of ridges 101 on the fingers may range from 0.5 to 1 mm.

Figure 5:
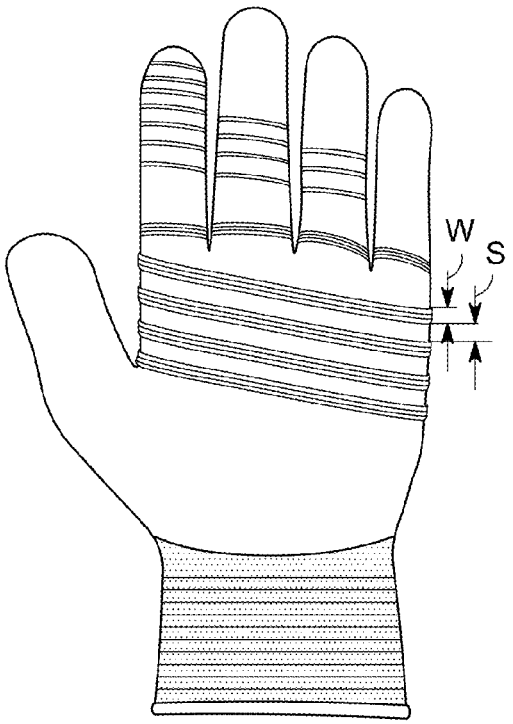
FIG. 5 depicts the back side of the liner of FIG. 4, according to embodiments of the invention.

FIG. 5 depicts the back side of the liner of FIG. 4, according to embodiments of the invention. Embodiments of the present invention may comprise ridges 117 traversing the entire circumference of any region of liner 200. As is discussed below, ridges 117 need not traverse the entire circumference of any liner disclosed herein. Also, in some embodiments, spacing S may be approximately 2 mm and Width W may be approximately 3 mm. Upper palm 112 of liner 200 may comprise ridges 3 mm in width W, 2 mm in spacing S, and height H between 1-2 mm. Cuff 116, which has twenty ridges 101, may have a height H of 1 mm, a spacing S of 2 mm, and a width W of 3 mm. The amount of ridges 101 may be varied to any practical number for a glove. Moreover, the size dimensions of ridges 101 may likewise be varied. Gloves of this design, which might be termed as having medium duty properties, have more ridges 101 having higher and wider dimensions, present a glove having superior gripability and impact resistance as compared with glove of FIGS. 1-3. Glove 200 may optionally comprise a cuff 116 having a size-adjustment, for example, by hook-and-loop fasteners or other fasteners.

Figure 6:
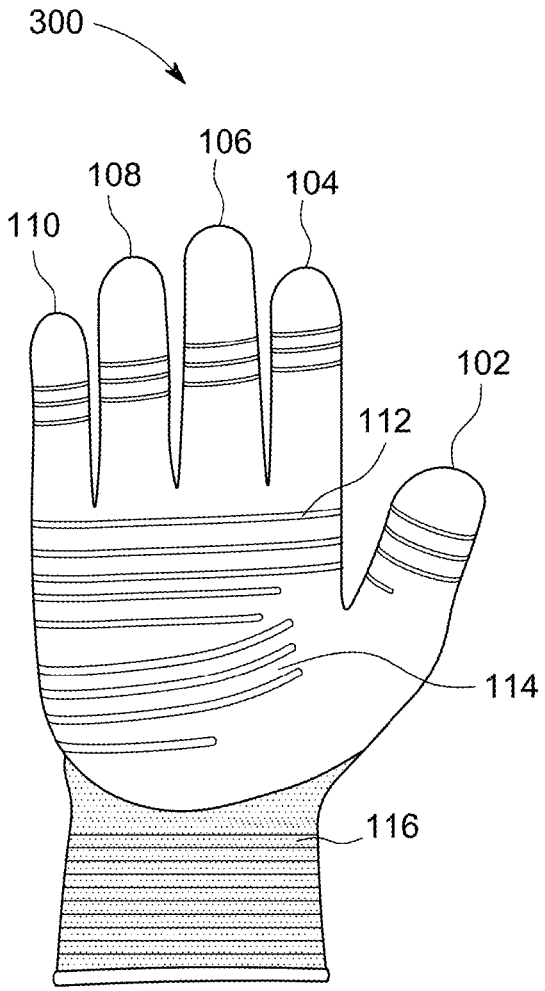
FIG. 6 depicts the palm side of a liner according to embodiments of the invention.
Figure 7:
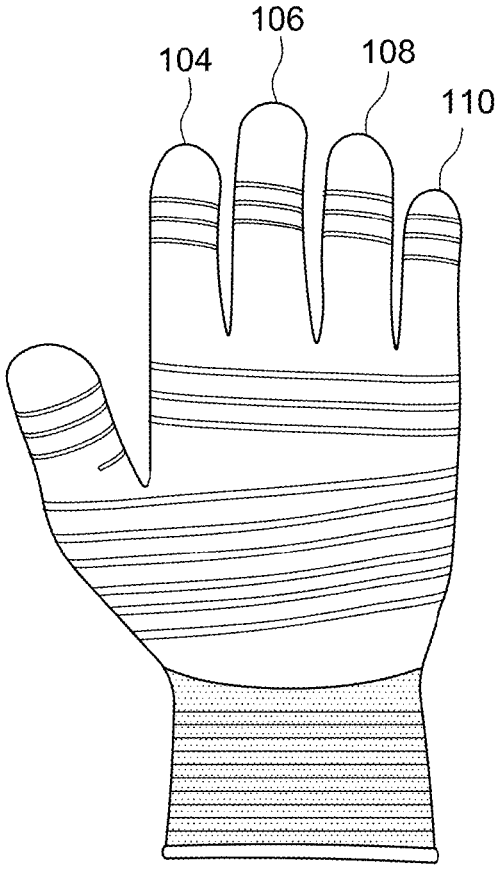
FIG. 7 depicts the back side of some embodiments of the liner according to embodiments of the invention.
Figure 8:
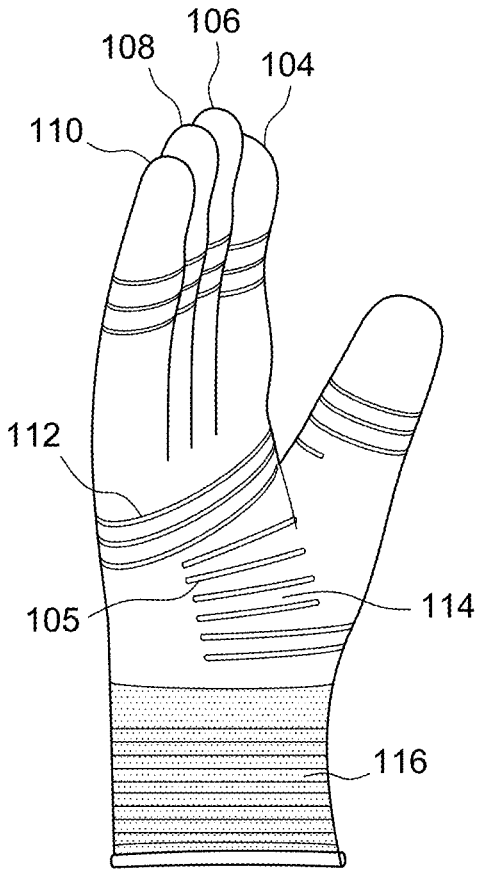
FIG. 8 depicts the left side view of FIG. 6, according to embodiments of the invention.

FIG. 6 depicts the palm side of a liner according to embodiments of the invention. Liner 300 is shown in FIGS. 6-7. Liner 300 may comprise ridges 101 on cuff 116, and on fingers 104, 106, 108, and 110 and thumb 102. As shown, each of thumb 102, index finger 104, middle finger 106, ring finger 108, and pinky finger 110 comprises three sets of ridges 101. Thumb 102 further comprises a discontinuous ridge 105 on the palm side of liner 300 (as shown in FIG. 8 below), while having additional ridges 101 on fingers 104, 106, and 108. Cuff 116, which has ten sets of ridges 101, may have a height H of 1 mm, a spacing S of 2 mm, and a width W of 3 mm. As discussed above, the amount of ridges 101 may be varied to any reasonable number on any finger, thumb, upper or lower palm, cuff, backhand area, or knuckle. As discussed above, the dimensions of ridges 101 may likewise be varied. Gloves of this design, which have more ridges 101 having higher and wider dimensions present a heavy-duty glove having superior gripability, cut-, and impact-resistance as compared with either liner 100 of FIGS. 1-3 or glove 200 of FIGS. 4-5.

FIG. 8 depicts the left side view of FIG. 6, according to embodiments of the invention. Many of ridges 101 on lower palm 114 (as shown in FIGS. 6-7 as above), upper palm 112 and knuckle area 120 (as shown in FIG. 7) do not traverse the full circumference of liner 300, such as discontinuous ridges 105. Discontinuous ridges according to embodiments of the invention of this design offer greater flexibility while nonetheless providing abrasion- and cut-resistance in specified areas of the gloves. In other words, ridges 101 may be present, optionally, only on the palm side or knuckle side of the glove, terminating without making a ring around the entire glove. Because of this feature, glove 300 has additional flexibility and comfort as well as cut resistance, abrasion resistance, and the like. Moreover, discontinuous ridges may also be on fingers 104, 106, 108, and 110 as well as thumb 102 in any embodiment of the present invention. Other ridge designs are possible within the scope of embodiments of the invention, such as those disclosed in commonly-assigned U.S. Patent application Ser. No. 29/443,107, filed Jan. 14, 2013, which is hereby incorporated by reference in its entirety.

Figure 9:
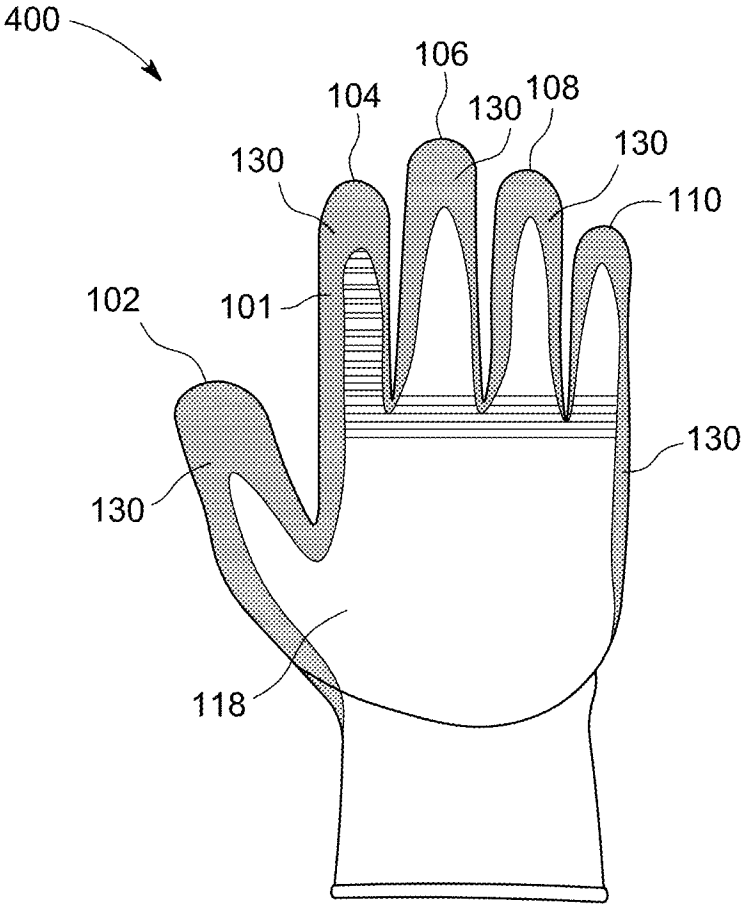
FIG. 9 depicts a back hand view of a dipped glove according to embodiments of the invention.

FIG. 9 depicts a back hand view of dipped glove according to embodiments of the invention. Any knitted liner having ridges 101 may be coated with a polymeric material.

For example, a latex coating may comprise a natural rubber latex, such as guayule or polyisoprene, synthetic latexes, such as synthetic polyisoprene, carboxylated acrylonitrile butadiene, non-carboxylated acrylonitrile butadiene, butyl latex, polychloroprene, nitriles, polyurethane, styrene-butadiene, acrylonitrile-butadiene, and the like, or blends thereof. The coating on liners 100, 200, 300 can comprise a palm dip, knuckle dip, finger dip, three-quarters dip, full dip, and the like as needed for specific applications using the dip processes as described in commonly assigned U.S. patent application Publ. No. 2009/0211305, which is incorporated herein by reference in its entirety. Liners may be dipped or sprayed with a coagulant. The coagulant causes the polymeric coating to set on the fabric of the liner, preventing strikethrough of the coating. In FIG. 9, glove 400 comprises a polymeric coating dip 130. As shown, the back hand side of fingers and thumb, and back hand 118 are only partially covered with coating dip 130, and ridges 101 are similarly partially covered.

Figure 10:
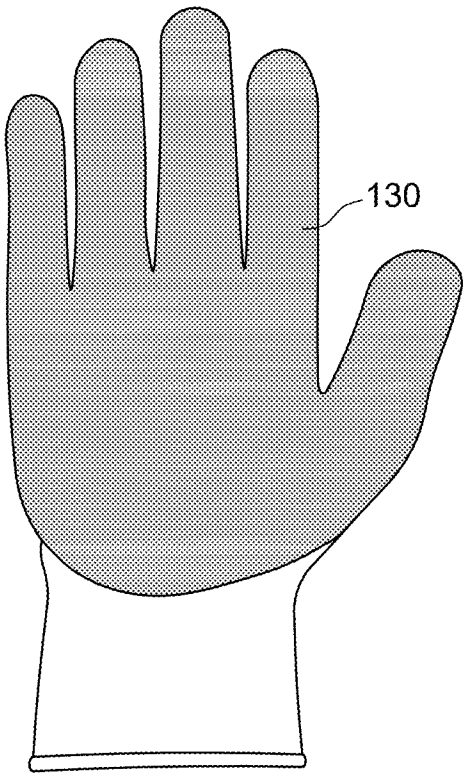
FIG. 10 depicts a palm side view of a dipped glove according to embodiments of the invention.

FIG. 10 depicts a palm side view of a dipped glove according to embodiments of the invention. In FIG. 10, glove 400 comprises a palm dip, in which the coating dip 130 completely covers the palm and the ridges 101 disposed thereon (not shown). Also, gloves in accordance with embodiments of the invention may further comprise coatings that are foamed or unfoamed. Additionally, coatings may be built up in layers or in varying thickness. The layers may comprise the same or different polymeric materials. Additionally, the coatings may further comprise textured surfaces (not shown).

All ranges recited herein include ranges therebetween, and can be inclusive or exclusive of the endpoints. Optional included ranges can be from integer values therebetween, at the order of magnitude recited or the next smaller order of magnitude. For example, if the lower range value is 0.1, optional included endpoints can be 0.2, 0.3, 0.4 . . . 1.1, 1.2, and the like, as well as 1, 2, 3 and the like; if the higher range is 8, optional included endpoints can be 7, 6, and the like, as well as 7.9, 7.8, and the like.

While the foregoing is directed to embodiments of the present invention, other and further embodiments of the invention may be devised without departing from the basic scope thereof, and the scope thereof is determined by the claims that follow.

The invention claimed is:

1. A seamless knitted glove, comprising:

a knitted liner including a main yarn and having a thumb, an index finger, a middle finger, a ring finger, a pinky finger, an upper palm, a lower palm, and a cuff;

a plurality of knitted ridges knitted within at least the index finger and the upper palm, wherein the knitted ridges comprise a nylon, a nylon wrapped elastane, elastane, polyester, aramid, ultra-high molecular weight polyethylene, steel wire, fiberglass, carbon, or any blend of the fibers and materials thereof and project from an outer surface of the liner for increasing grip properties on a palm side and impact properties on a back side of the glove; and a foamed latex palm-dip coating disposed on the knitted liner and at least one knitted ridge.

2. The glove of claim 1, wherein the plurality of knitted ridges comprise a ridge yarn different than the main yarn.

3. The glove of claim 2, wherein the ridge yarn comprises one or more of an abrasion, cut, and impact resistant yarn.

4. The glove of claim 2, wherein the ridge yarn is a plaited yarn.

5. The glove of claim 1, wherein the plurality of knitted ridges are continuous.

6. The glove of claim 1, wherein the plurality of knitted ridges are discontinuous.

7. The glove of claim 1, wherein the main yarn comprises natural yarns, synthetic yarns, cotton, wool, polyethylene, polypropylene, polyester, nylon, elastane, or blends thereof.

8. The glove of claim 1, wherein the plurality of knitted ridges project from the outer surface of the liner from 0.1 mm to 8 mm in height.

9. The glove of claim 1, wherein the width of the at least one knitted ridge ranges from 1 to 3 mm.

10. The glove of claim 1, further comprising at least one knitted ridge projecting from a crotch between the upper palm and the index finger, the middle finger, or the ring finger.

11. The glove of claim 10, wherein the knitted ridges are spaced about 1 to 3 mm apart.

12. The glove of claim 1, wherein the latex coating further comprises a knuckle dip, finger dip, three-quarters dip, or full dip.

13. The glove of claim 1, wherein the latex coating comprises natural rubber latex, guayule, polyisoprene, synthetic latexes, non-carboxylated acrylonitrile butadiene, carboxylated acrylonitrile butadiene, butyl latex, polychloroprene, polyurethane, styrene-butadiene, acrylonitrile-butadiene, nitriles, or blends thereof.

14. A seamless knitted glove, comprising:

a glove having a thumb portion, index finger portion, middle finger portion, ring finger portion, pinky portion, palm portion, and knuckle portion, the thumb, index finger, a middle finger, a ring finger, pinky, palm, and knuckle portions including a first yarn; and at least one knitted ridge disposed in a crotch formed between the index finger portion and the middle finger portion, at least one knitted ridge disposed in a crotch formed between the middle finger portion and the ring finger portion, and at least one knitted ridge disposed in a crotch formed between the ring finger portion and the pinky portion, the knitted ridges including a second yarn, wherein the knitted ridges project from an outer surface of the glove, and wherein at least one of the thumb, index finger, a middle finger, a ring finger, pinky, palm, and knuckle portions include at least one knitted reinforcing ridge to provide protection against impacts, vibrations, abrasions, and injuries caused by cuts and contact with hard or pointed objects.

* * * * *